US006675977B2

(12) United States Patent
Parks

(10) Patent No.: US 6,675,977 B2
(45) Date of Patent: Jan. 13, 2004

(54) DUAL BAND DISHWASHER CLIP

(76) Inventor: Charles K. Parks, Box 7552, Fort Worth, TX (US) 76111-0552

( * ) Notice: Subject to any disclaimer, the term of this patent is extended or adjusted under 35 U.S.C. 154(b) by 131 days.

(21) Appl. No.: 10/086,958

(22) Filed: Mar. 4, 2002

(65) Prior Publication Data

US 2003/0164344 A1 Sep. 4, 2003

(51) Int. Cl.[7] ..... A47F 5/00

(52) U.S. Cl. ..... 211/41.9; 211/41.8; 24/300; 24/301

(58) Field of Search ..... 211/41.9, 41.8; 24/300, 301

(56) References Cited

U.S. PATENT DOCUMENTS

| | | | | | |
|---|---|---|---|---|---|
| 913,962 | A | | 3/1909 | Liddy | |
| 4,367,572 | A | | 1/1983 | Zielensky | 24/301 |
| 4,432,121 | A | * | 2/1984 | Dupre | |
| 4,569,108 | A | | 2/1986 | Schwab | 24/17 |
| 4,832,206 | A | * | 5/1989 | Cunningham | 211/41.9 |
| 4,869,375 | A | | 9/1989 | Lamb | 211/41 |
| 4,885,824 | A | | 12/1989 | Schwab et al. | 24/17 B |
| 4,974,806 | A | * | 12/1990 | Matern | |
| 5,114,019 | A | * | 5/1992 | Sandbank | 211/41.9 |
| 5,121,843 | A | * | 6/1992 | Elder | 211/41.9 |
| 5,201,826 | A | * | 4/1993 | Zimmermann | 211/41.9 |
| 5,294,008 | A | | 3/1994 | Dunaway | 211/41 |
| D362,520 | S | * | 9/1995 | Lunsford | |
| 5,459,905 | A | | 10/1995 | Voyre | 24/17 B |
| 5,797,167 | A | * | 8/1998 | Schwab | 24/300 X |
| 6,065,916 | A | * | 5/2000 | Swensen | |

* cited by examiner

*Primary Examiner*—Robert W. Gibson, Jr.
(74) *Attorney, Agent, or Firm*—John M. Harrison

(57) ABSTRACT

A dual band dishwasher clip which is suitable for retaining and preventing undesired movement of articles such as lightweight, typically plastic articles, in a dishwasher rack during operation of an automatic dishwasher. The dual band dishwasher clip includes a pair of dishwasher clip fasteners for engaging the dishwasher rack. An elastic band engages the dishwasher clip fasteners, and each of the dishwasher clip fasteners includes a rack-engaging mechanism for receiving the dishwasher rack and a pair of spaced-apart spacers provided on the rack-engaging mechanism and engaging the elastic band. The spacers define a pair of engaging band segments of the elastic band which extend between the dishwasher clip fasteners and engage and secure the articles in the dishwasher rack.

18 Claims, 2 Drawing Sheets

DUAL BAND DISHWASHER CLIP

BACKGROUND OF THE INVENTION

Field of the Invention

This invention relates to devices for securing articles and more particularly, to a dual band dishwasher clip which is suitable for retaining and preventing undesired movement of articles such as lightweight plastic plates, cups, bowls, saucers, salad tongs and other containers and implements in a dishwasher rack during operation of an automatic dishwasher. The dual band dishwasher clip includes a pair of dishwasher clip fasteners for engaging the dishwasher rack. An elastic band engages the dishwasher clip fasteners, and each of the dishwasher clip fasteners includes a rack-engaging mechanism for receiving the dishwasher rack and a pair of spaced-apart spacers provided on the rack-engaging mechanism and engaging the elastic band. The spacers define a pair of engaging band segments of the elastic band which extend between the dishwasher clip fasteners and engage and secure the articles in the dishwasher rack.

During operation of automatic dishwashers, lightweight plates and dishes such as lightweight plastic articles, including food containers, bowls, saucers, plates, cups, salad tongs and the like frequently undergo undesirable movement due to high-pressure water spraying in the dishwasher interior and are found in a state of disarray when the washing and drying cycles are over and the dishwasher is opened. Many times the lightweight bowls, glasses and other containers are found in an upright position and fall of water, and must be emptied of the water and dried off before placement in a drawer or cabinet. This increases the time and labor burden associated with the automatic dishwashing process. Accordingly, a device is needed which is capable of securing articles of all description, but especially plastic articles, in dishwashers in order to prevent striking and chipping of plates and dishes against each other and to prevent lightweight articles, implements and containers from changing orientation and collecting water during operation of the dishwasher.

A number of devices are known in the art for fastening articles to each other or securing the articles in a dishwasher or other enclosure. Patents of interest in this regard include U.S. Pat. Nos. 913,962; 4,367,572; 4,569,108; 4,869,375; 4,885,824; 5,294,008; and 5,459,905.

An object of the present invention is to provide a device which is suitable for securing a wide variety of articles on a rack or other support.

Another object of this invention is to provide a dishwasher clip which can be used to retain lightweight articles in a dishwasher rack during operation of the dishwasher.

Still another object of this invention is to provide a dual band dishwasher clip which utilizes elastic bands of a desired size to secure and prevent undesired movement of lightweight plastic and other articles in a dishwasher rack.

SUMMARY OF THE INVENTION

These and other objects of the invention are provided in a dual band dishwasher clip which is suitable for retaining and preventing undesired movement of all types of articles and especially lightweight plastic cups, saucers, plates, bowls, salad tongs and other articles and implements in a dishwasher rack during operation of the dishwasher. The dual band dishwasher clip includes a pair of dishwasher clip fasteners for engaging the dishwasher rack. An elastic band engages the dishwasher clip fasteners, and each of the dishwasher clip fasteners includes a rack-engaging mechanism for receiving the dishwasher rack and a pair of spaced-apart spacers provided on the rack-engaging mechanism and engaging the elastic band. Accordingly, the spacers define a pair of engaging band segments of the elastic band which extend between the dishwasher clip fasteners and engage and secure the articles and implements in the dishwasher rack.

BRIEF DESCRIPTION OF THE DRAWINGS

The invention will be better understood by reference to the accompanying drawings, wherein.

DESCRIPTION OF THE PREFERRED EMBODIMENTS

Figure 1:
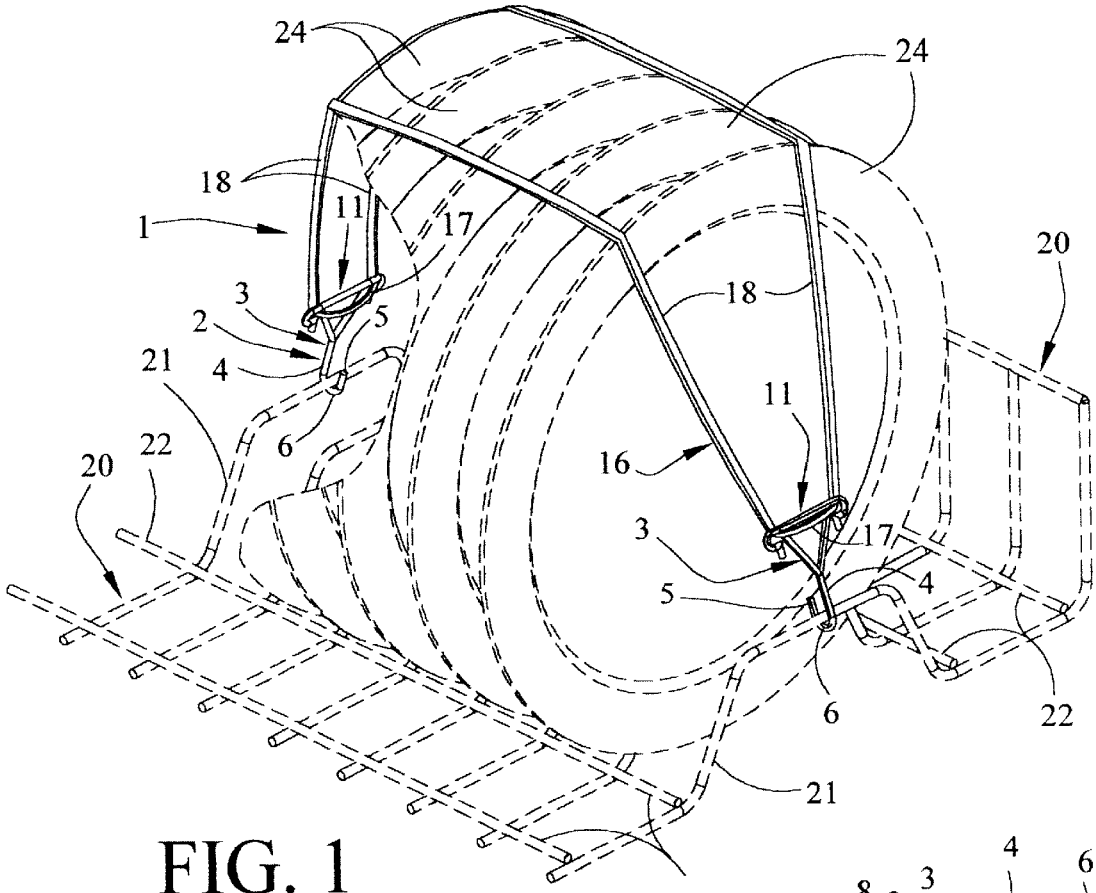
FIG. 1 is a perspective view of a conventional dishwasher rack, partially in section, with multiple plates loaded on the dishwasher rack and the dual band dishwasher clip of this invention securing the plates in the dishwasher rack.

Referring initially to FIGS. 1–4 of the drawings, in an illustrative embodiment the dual band dishwasher clip of this invention is generally illustrated by reference numeral 1. The dual band dishwasher clip 1 includes a pair of dishwasher clip fasteners 2, each having a clip frame 3 typically constructed of plastic or metal and adapted for engaging various elements such as separate upward-standing plate supports 21 of a conventional dishwasher rack 20, as illustrated in FIG. 1 and hereinafter described. The clip frame 3 of each dishwasher clip fastener 2 includes an engaging leg 4, having a leg curve 6 which is terminated by a leg end 5. A pair of spacer arms 8 diverges from the proximal end of the engaging leg 4 at a leg/arm junction 9, and the spacer arms 8 terminate in spaced-apart relationship to each other on the elongated crosspiece 11*a* of a band mount 11. In another embodiment of the invention (not illustrated), the spacer arms 8 extend from the-engaging leg 4 in substantially parallel relationship to each other and terminate in spaced-apart relationship on the crosspiece 11*a* of the band mount 11. Band stays 12, each of which is typically curved in configuration but which may be any suitable alternative configuration, terminate the ends of the crosspiece 11*a* at respective band mount/arm junctions 14, and a band stay end 13 may project from the end of each band stay 12.

Figure 2:
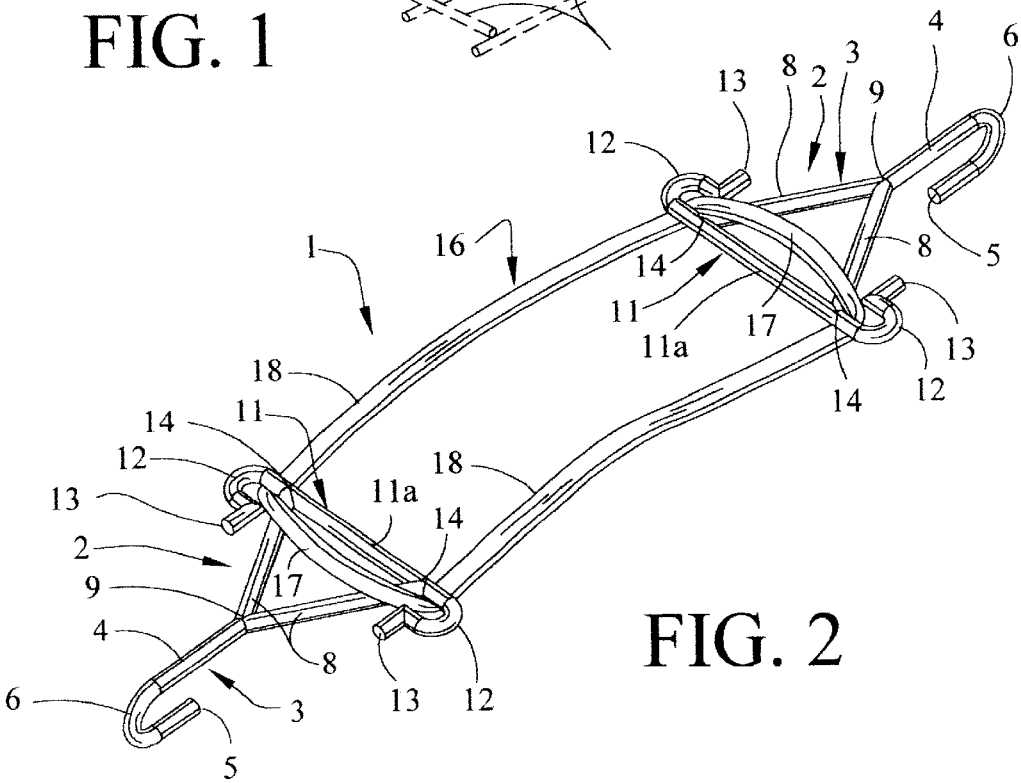
FIG. 2 is a perspective view of a preferred embodiment of the dual band dishwasher clip of this invention.
Figure 3:
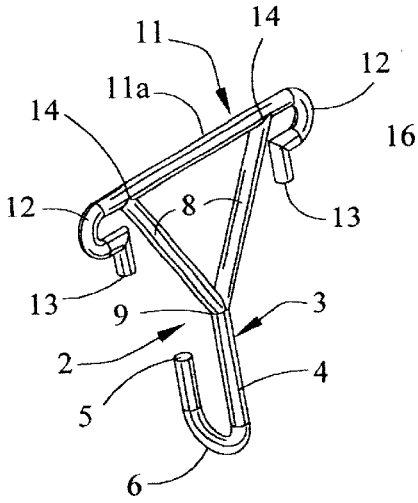
FIG. 3 is a perspective view of a preferred dishwasher clip fastener element of the dual band dishwasher clip.
Figure 4:
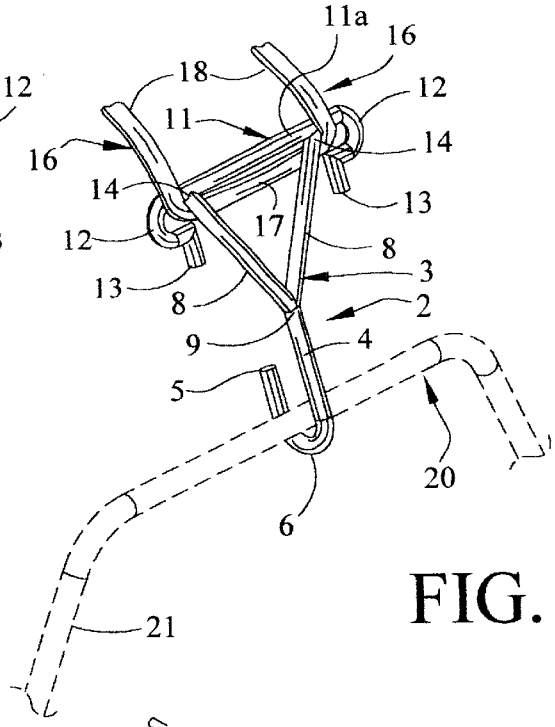
FIG. 4 is a perspective view of the dishwasher clip fastener element illustrated in FIG. 3, with the dishwasher clip fastener engaging the dishwasher rack and an elastic band (partially in section) engaging the fastener.

As further illustrated in FIG. 2, an elastic band 16, which may be a band of any suitable length and thickness and constructed of rubber or any suitable elastic material, spans the dishwasher clip fasteners 2 of the dual band dishwasher clip 1, with each end of the elastic band 16 engaging the corresponding clip fastener 2. Accordingly, the elastic band 16 is initially inserted between each band stay end 13 and corresponding spacer arm 8 of each dishwasher clip fastener 2 and positioned in each band stay 12 on the sides of the respective spacer arms 8, defining an engaged band segment 17 of the elastic band 16 which extends between the band stays 12 of each dishwasher clip fastener 2. A pair of parallel engaging band segments 18 of the elastic band 16 extends between the corresponding pairs of band stays 12 of the respective dishwasher clip fasteners 2.

Referring again to FIGS. 1 and 4 of the drawings, in typical application the dual band dishwasher clip 1 is capable of retaining and securing a set of multiple, (typically lightweight) plates 24 in a dishwasher rack 20. A typical conventional dishwasher rack 20 includes multiple, transverse plate supports 21, secured in adjacent, parallel, upward-standing relationship in the dishwasher rack 20 by means of multiple, longitudinal rack bars 22, with the plates 24 inserted between adjacent ones of the plate supports 21. Accordingly, one of the dishwasher clip fasteners 2 of the dual band dishwasher clip 1 is attached to one of the plate supports 21 at the front or rear end of the set of multiple plates 24, by latching the leg curve 6 of the engaging leg 4 of the dishwasher clip fastener 2 on the plate support 21. The remaining, unattached dishwasher clip fastener 2 is pulled across the top of the plates 24 as the parallel engaging band segments 18 of the elastic band 16 engage the upper edges of the plates 24, in spaced-apart relationship to each other. The dishwasher clip fastener 2 is then attached to one of the plate supports 21 at the other end of the set of multiple plates 24, by latching the leg curve 6 of the engaging leg 4 with the plate support 21 as further illustrated in FIG. 1 and heretofore described. Accordingly, the engaging band segments 18 of the elastic band 16 tightly engage the plates 24 and prevent the plates 24 from sideways or other undesirable movement in the dishwasher rack 20 during operation of the dishwasher (not illustrated), to prevent chipping, breakage or disorderly positioning of the plates 24 during the dishwashing cycle. The dual band dishwasher clip 1 is removed from the plate-securing position illustrated in FIG. 1, by unlatching the dishwasher clip fasteners 2 from the respective plate supports 21 of the dishwasher rack 20.

Figure 5:
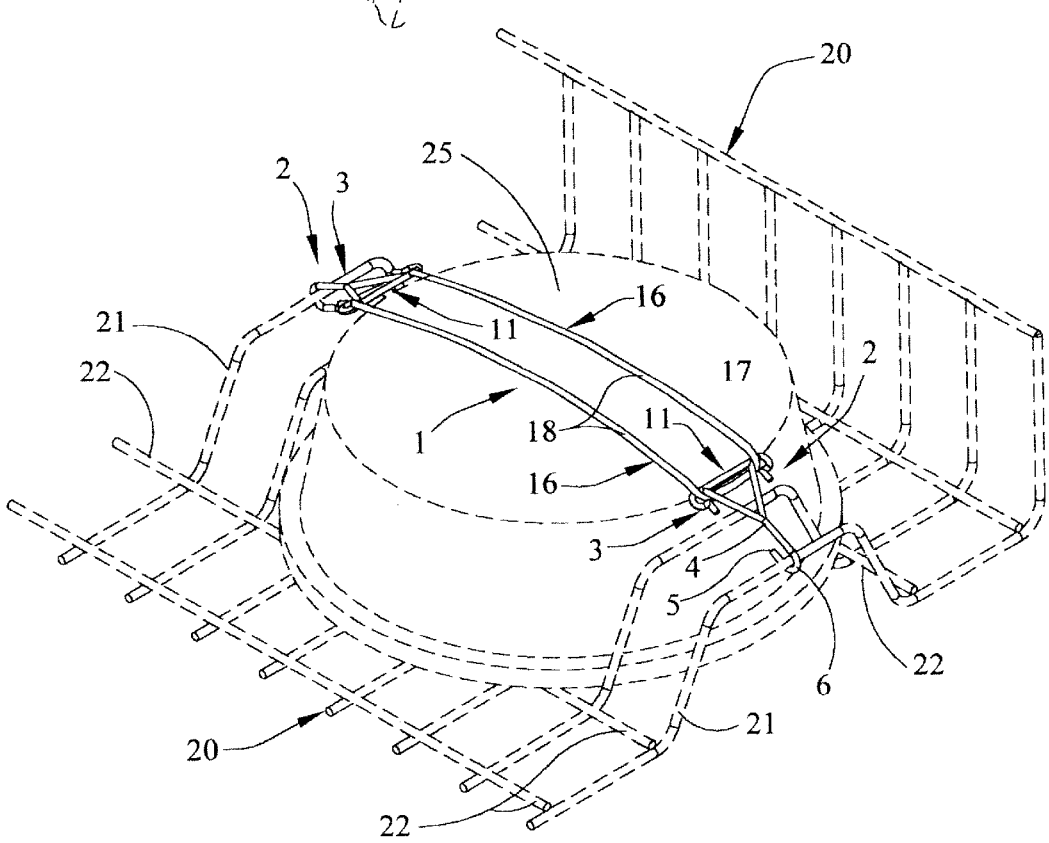
FIG. 5 is a perspective view of the dual band dishwasher clip, retaining an inverted pan in a dishwasher rack (partially in section) in typical application of the dual band dishwasher clip.

Referring next to FIG. 5 of the drawings, it will be appreciated by those skilled in the art that the dual band dishwasher clip 1 can be used to secure a pan 25, dish or other container in an inverted configuration on the dishwasher rack 20 in order to prevent the pan 25, dish or other container from undesired movement in the dishwasher during the dishwashing operation. Accordingly, the pan 25 is placed face-down on the dishwasher rack 20, with the sides of the pan 25 inserted between adjacent ones of the plate supports 21. One of the dishwasher clip fasteners 2 is attached to a plate support 21 on one side of the inverted pan 25, after which the other dishwasher clip fastener 2 is extended across the upward-facing bottom of the pan 25 and attached to a plate support 21 on the opposite side of the pan 25. Accordingly, the pan 25 is secured in the dishwasher rack 20 in the inverted configuration such that the pan 25 is incapable of turning over and filling with water, for example, and other undesired movement of the pan 25 in the dishwasher is prevented, during operation of the dishwasher.

It will be appreciated by those skilled in the art that the dual band dishwasher clip of this invention is capable of attachment to the various elements of a dishwasher rack to secure dishes, pans, bowls, plates and other articles and implements of assorted weight, size and shape in an automatic dishwasher to prevent undesired movement of the articles and implements in the dishwasher during the dishwashing operation. Referring again to FIG. 2 of the drawings, it is understood that the engaging leg 4 and leg curve 6 for facilitating attachment of the dual band dishwasher clip 1 to the dishwasher rack 20 (FIG. 1) can be replaced by any suitable attachment device known to those skilled in the art, including clips and hooks (not illustrated) of desired configuration, in non-exclusive particular. Furthermore, it is understood that the band stays 12 of the clip frame 3 can be rectangular, triangular or any other suitable configuration, as desired, or the band stays 12 can be omitted from the respective ends of the crosspiece 11*a* of the band mount 11 and replaced with the protruding band stay ends 13 extending directly from the crosspiece 11*a* to retain the engaged band segment 17 portion of the elastic band 16 between the band stay end 13 and corresponding spacer arm 8 of the clip frame 3. It is further understood that the band stays 12 and band stay ends 13 can be omitted from the respective ends of the crosspiece 11*a* of the band mount 11, and the crosspiece 11*a* extended in length to retain the elastic band 16 on the respective extended ends of the crosspiece 11*a*. The dual band dishwasher clip 1 is capable of use with elastic bands 16 of various sizes and designs, and the elastic band 16 may be characterized by multiple cross segments (not illustrated) which span the engaging band segments 18 thereof to form an elastic meshwork or netting.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. A dual band dishwasher clip for retaining articles in a dishwasher rack, said dual band dishwasher clip comprising:

an elongated, elastic band;

a pair of dishwasher clip fasteners engaging respective ends of said elastic band for engaging the dishwasher rack;

wherein said pair of dishwasher clip fasteners each comprises a rack-engaging mechanism for removably engaging the dishwasher rack and a pair of spacer arms provided in spaced-apart relationship with respect to each other on said rack-engaging mechanism and a pair of band stays disposed in adjacent relationship with respect to said pair of spacer arms, respectively, for retaining said elastic band on said pair of spacer arms;

wherein said elastic band defines a pair of engaging band segments extending between said pair of dishwasher clip fasteners for removably engaging the articles in the dishwasher rack.

2. The dual band dishwasher clip of claim 1 wherein said rack-engaging mechanism comprises an engaging leg extending from said pair of spacer arms and a leg curve defined in said engaging leg for receiving the dishwasher rack.

3. The dual band dishwasher clip of claim 1 wherein each of said pair of band stays is curved.

4. The dual band dishwasher clip of claim 3 wherein said rack-engaging mechanism comprises an engaging leg extending from said pair of spacer arms and a leg curve defined in said engaging leg for receiving the dishwasher rack.

5. A dual band dishwasher clip for retaining articles in a dishwasher rack, said dual band dishwasher clip comprising:

a pair of dishwasher clip fasteners for engaging the dishwasher rack;

an elastic band engaging said pair of dishwasher clip fasteners, respectively;

wherein said pair of dishwasher clip fasteners each comprises a rack-engaging mechanism for receiving the dishwasher rack, a pair of spaced-apart spacer arms provided on said rack-engaging mechanism for engaging said elastic band and a band mount spanning said pair of spacer arms for retaining said elastic band on said pair of dishwasher clip fasteners, respectively; and wherein said pair of spacer arms defines in said elastic band a pair of generally parallel, spaced-apart engaging band segments extending between said pair of dishwasher clip fasteners for engaging the articles in the dishwasher rack and a pair of engaged band segments extending between said pair of spacer arms of said pair of dishwasher clip fasteners, respectively.

6. The dual band dishwasher clip of claim 5 wherein said rack-engaging mechanism comprises an engaging leg extending from said pair of spacer arms and a leg curve defined in said engaging leg for receiving the dishwasher rack.

7. The dual band dishwasher clip of claim 5 comprising a pair of spaced-apart band stays provided on said spacer arms for further retaining said elastic band on said pair of dishwasher clip fasteners, respectively.

8. The dual band dishwasher clip of claim 7 wherein said rack-engaging mechanism comprises an engaging leg extending from said pair of spacer arms and a leg curve defined in said engaging leg for receiving the dishwasher rack.

9. The dual band dishwasher clip of claim 7 wherein each of said pair of band stays is curved.

10. The dual band dishwasher clip of claim 9 wherein said rack-engaging mechanism comprises an engaging leg extending from said pair of spacer arms and a leg curve defined in said engaging leg for receiving the dishwasher rack.

11. A dual band dishwasher clip for retaining articles in a dishwasher rack, said dual band dishwasher clip comprising:

a pair of dishwasher clip fasteners for engaging the dishwasher rack;

an elastic band engaging said pair of dishwasher clip fasteners, respectively;

wherein said pair of dishwasher clip fasteners each comprises a rack-engaging mechanism for receiving the dishwasher rack, a pair of spacer arms diverging from said rack-engaging mechanism for engaging said elastic band and a pair of band stays disposed in adjacent relationship to said pair of spacer arms, respectively, for retaining said elastic band on said pair of spacer arms; and wherein said pair of spacer arms defines in said elastic band a pair of generally parallel, spaced-apart engaging band segments extending between said pair of dishwasher clip fasteners for engaging the articles in the dishwasher rack and a pair of engaged band segments extending between said pair of spacer arms of said pair of dishwasher clip fasteners, respectively.

12. The dual band dishwasher clip of claim 11 wherein said rack-engaging mechanism comprises an engaging leg extending from said pair of spacer arms and a leg curve provided in said engaging leg for receiving the dishwasher rack.

13. The dual band dishwasher clip of claim 11 wherein each of said pair of band stays is curved.

14. The dual band dishwasher clip of claim 13 wherein said rack-engaging mechanism comprises an engaging leg extending from said pair of spacer arms and a leg curve provided in said engaging leg for receiving the dishwasher rack.

15. The dual band dishwasher clip of claim 11 comprising a band mount spanning said pair of spacer arms and wherein said pair of band stays is provided on said band mount.

16. The dual band dishwasher clip of claim 15 wherein said rack-engaging mechanism comprises an engaging leg extending from said pair of spacer arms and a leg curve provided in said engaging leg for receiving the dishwasher rack.

17. The dual band dishwasher clip of claim 15 wherein each of said pair of band stays is curved.

18. The dual band dishwasher clip of claim 17 wherein said rack-engaging mechanism comprises an engaging leg extending from said pair of spacer arms and a leg curve provided in said engaging leg for receiving the dishwasher rack.

* * * * *